US007201086B2

(12) United States Patent
Hansen

(10) Patent No.: US 7,201,086 B2
(45) Date of Patent: Apr. 10, 2007

(54) WRENCH WITH ARTICULATING HEAD

(76) Inventor: Ronald A. Hansen, P.O. Box 156, Whitehouse, TX (US) 75791

( * ) Notice: Subject to any disclaimer, the term of this patent is extended or adjusted under 35 U.S.C. 154(b) by 0 days.

(21) Appl. No.: 11/207,688

(22) Filed: Aug. 19, 2005

(65) Prior Publication Data

US 2005/0274235 A1 Dec. 15, 2005

Related U.S. Application Data

(63) Continuation-in-part of application No. 09/824,405, filed on Apr. 2, 2001, now abandoned.

(51) Int. Cl.

| | |
|---|---|
| ***B24B 23/16*** | (2006.01) |
| ***B24B 1/00*** | (2006.01) |
| ***B24B 1/02*** | (2006.01) |
| ***B24B 13/00*** | (2006.01) |

(52) U.S. Cl. ..... 81/177.8; 81/177.85; 81/177.6; 81/177.7; 81/125.1; 81/124.5

(58) Field of Classification Search ..... 81/177.8, 81/177.9, 125.1, 177.6, 177.7, 177.85, 124.5
See application file for complete search history.

(56) References Cited

U.S. PATENT DOCUMENTS 1,060,494 A * 4/1913 Reynolds ..... 81/177.8
1,109,032 A * 9/1914 Bersted ..... 81/177.8

* cited by examiner

*Primary Examiner*—Lee D. Wilson
*Assistant Examiner*—Bryan Muller
(74) *Attorney, Agent, or Firm*—Ronald B. Sefrna

(57) ABSTRACT

An articulated wrench includes an elongate handle with a generally U-shaped depression at an end of the handle with an edge portion of the handle extending on either side of the depression, and a wrench head formed as a generally planar body with an aperture therein for engaging a fastener to be turned with the wrench, with the body of the wrench head nested into the depression in the handle with the edge portions of the handle on either side of the depression extending along a portion of the edge of the wrench head, and with the wrench head pivotally interconnected to the handle so as to allow rotation of the wrench head relative to the handle. The proportions of the wrench head are selected and the connection between wrench head and handle are selected so as to minimize the clearance required between a fastener and adjacent obstructions in a confined space for engagement of the fastener with the wrench.

19 Claims, 15 Drawing Sheets

WRENCH WITH ARTICULATING HEAD

REFERENCE TO RELATED APPLICATION

This application is a Continuation In Part of U.S. patent application Ser. No. 09/824,405, originally filed Apr. 2, 2001, now abandoned and titled "Articulated Wrench".

FIELD OF THE INVENTION

The present invention generally relates to hand tools, and in its preferred embodiments more specifically relates to a wrench with an articulating head pivotally connected to the handle of the wrench so as to provide access to fasteners in otherwise inaccessible confined spaces.

BACKGROUND OF THE INVENTION

It is not unusual for bolt heads, nuts, screws and the like used in the construction of various machines and structures to be placed in locations in which they are difficult to engage and turn with conventional tools. This situation is increasingly prevalent in the automotive field, as engines and transmission systems, as well as auxiliary and control systems become more complex and sophisticated, and engine compartments become smaller. In almost all fields the increased focus on increased efficiency, refinement, and space saving has been very beneficial for users, but has created problems for mechanics and technicians who service the machines and equipment, by limiting space and access. In many instances tools designed for use in less restricted environments are difficult, and often impossible, to use today.

Engaging and turning threaded fasteners such as bolts and nuts with a wrench is an increasingly common and vexing problem. The problem with fastener accessibility has been developing over time along with the developments and changes in design. Over that time, and throughout the changes that have occurred in design and fastener placement, the accessibility of fasteners with a rigid, fixed head wrench has diminished. Fasteners are sometimes found in locations in which direct access from the top is blocked, precluding the use of a conventional socket wrench; direct access with a straight conventional wrench is blocked; and in which clearance between the fastener and obstructions on at least one, and often all, sides of the fastener is very limited. One such environment is shown in FIGS. 1 and 2 of the accompanying drawings, which are intended to be illustrative and not limiting of the scope of the problem. In order to reach fasteners disposed in such locations it has become more and more common for mechanics and other technicians to spend time and effort removing components that block access, for the sole reason of gaining access to otherwise inaccessible fasteners. This practice is not only time consuming, but increases the risk of damage to parts or components that must be removed and replaced even though they are not otherwise involved in the service or repair operation being performed.

One approach that has been tried in an effort to overcome this problem is the use of wrenches with pivoting heads, in which the component engaging head is pivotally connected to the wrench handle so the plane of the head can be disposed at an angle to the handle. Examples of wrenches with pivoting heads from the prior art include:

| Patent Number | Title | Patentee |
|---|---|---|
| U.S. Pat. No. 1,060,494 | Wrench | Reynolds |
| U.S. Pat. No. 1,805,298 | Wrench | Schweigert |
| U.S. Pat. No. 3,186,265 | Wrench Having Angularly Adjustable Auxiliary Handle | Wenturine |
| U.S. Pat. No. 3,779,107 | Ratchet Wrench Tool Head Positioner | Avery |
| U.S. Pat. No. 4,084,456 | Wrench | Pasbrig |
| U.S. Pat. No. 4,794,829 | Ratchet-Type Wrench | Mesenboeller |
| U.S. Pat. No. 5,870,932 | Swift Wrench | Brooke |
| U.S. Pat. No. 6,000,302 | Tool Having Rotatable Driving Head | Chiang |
| U.S. Pat. No. 6,148,698 | Angle-Adjustable Box End Wrench | Hsich |
| U.S. Pat. No. 6,186,033 | Multi-Positional Turning Tool | Faro, Sr. |

These prior art designs do provide an articulation of the wrench head relative to the wrench handle, and serve to improve access in some situations, but each of the designs of the prior art suffers from disadvantages and drawbacks that continue to preclude access to fasteners in many situations that are becoming increasingly common. The disadvantages found in all prior art wrench designs relate in large part to the distance from the pivot point between the wrench head and handle, and the closest edge of the fastener engaging aperture in the wrench head. In some designs the length of extension of the wrench head, and/or the width of extension of the wrench head, beyond the outer edge of the engaged fastener is also a significant disadvantage.

In the Reynolds design, the wrench head is generally rectangular, of substantially greater length than width. The handle of the wrench widens substantially at the end to which the wrench head is attached, to form a wide fork, in which an extension member of the wrench head is received. A pivot pin extends through the two sides of the fork and the extension member to pivotally connect the head to the handle. A V-shaped notch extends into the head from the outer end, and is provided with a plurality of teeth along one side of the notch to allow the wrench head to engage fasteners of a variety of sizes. As a result, when a fastener at or near the lower limit of the sizes that can be accommodated by the wrench is engaged, the wrench head extends a great distance outward beyond the fastener and to each side of the fastener. The base of the notch is positioned a distance away from the pivot point of the head relative to the handle, creating a significant distance between the closest point of even the smallest fastener and the pivot point of the head. The head is indexed to be fixed and retained at certain rotational angles rather than being freely moveable.

Schweigert discloses an adjustable wrench head that is pivotally connected to a handle. The adjustment mechanism is disposed between the fastener engaging slot of the wrench head and the handle. The head includes an extension member that is engaged with a widened fork at the end of the handle and pinned in place. The distance between the pivot point and the fastener engaging slot is substantial, and the width of the head relative to the size of the fastener to be engaged is large, so that use of this wrench requires significant clearance around the fastener.

Wenturine discloses a ratchet-type box end head pivotally connected to a handle. The ratchet mechanism is disposed between the pivot pin connecting the head to the handle and the fastener engaging aperture in the head, which significantly increases the distance between that aperture and the pivot point. The rear portion of the head includes a slot within which a handle extension is inserted and pinned. This wrench requires significant clearance between a fastener and an adjacent obstruction.

Avery also discloses a wrench, of the socket drive type, with a ratchet mechanism disposed in the drive head, between the driver and the pivotal connection to the handle, creating a significant distance between the driver and the pivot point, and requiring significant clearance for use. The socket drive mechanism also inherently requires significant clearance above a fastener for use.

Pasbrig discloses an adjustable wrench in which the head is pivotally connected to an extension member, which is itself pivotally connected to a handle. The head of the Pasbrig wrench is pivotable in the plane of the head, and is also pivotable in the other direction relative to the handle. The structure used to accomplish this dual pivoting movement, as well as the structure for adjusting the wrench for different fastener sizes, results in the fastener engaging aperture being placed a substantial distance from even the closest pivot point. Significant clearance is required for use of this wrench.

Mesenhoeller provides a ratchet-type socket driver, with the driver head pivotally connected to a handle. An extension from the driver head is received and pinned in a widened fork formed in the handle The size of the ratchet mechanism, plus the length of the member extending between the head and the handle results in placement of the driver at a substantial distance from the pivot point. The ratchet mechanism also increases the width of the head. Significant clearance in all directions is required for use of this wrench.

Brooke shows an open end wrench in which the wrench head is pivotally connected to a handle so as to rotate in the plane of the head. The distance between the fastener engaging aperture and the pivot point is significant relative to the size of the aperture. The position of the head is fixed in a limited number of indexed positions.

Chiang also discloses a ratchet-type socket driver head pivotally connected to a handle. This wrench suffers from the same inherent disadvantages and large clearance requirements as discussed above with regard to other socket driver designs.

Hsich discloses a box end wrench head pivotally connected to a handle. The length of the wrench head is approximately twice the diameter of the fastener engaging aperture, and the pivot point is a substantial distance from that aperture, so that a significant clearance around a fastener is required for the use of this wrench.

Faro, Sr. discloses a wrench in which a wrench head is pivotally connected to a handle, with a long member extending between the wrench head and the connection to the handle. The length of the extension member is greater than the dimension of the opening of the fastener engaging aperture, so that significant clearance between fastener and obstruction is required for use of the wrench.

It can be readily seen that these wrench designs and others of the prior art, cannot be used to access and turn fasteners in many tightly confined spaces, such as but not limited to those illustrated in FIGS. 1 and 2. There remains a need for an articulated wrench that can be effectively used when only minimal clearance is available in all directions between the fastener component to be engaged and turned and adjacent structures.

SUMMARY OF THE INVENTION

The present invention provides an articulating wrench of the box end or open end type, having at least one head pivotally interconnected to the handle of the wrench. The wrench of the invention is particularly useful for effectively engaging fasteners such as nuts and bolt heads that are disposed in locations that provide such limited access that no wrench known in the prior art can be used for engaging and turning such components. FIGS. 1, 2, and 3 illustrate some situations in which fasteners are disposed in close proximity to obstructions and access to the fasteners is limited.

In the wrench of the invention the wrench head structure and the end portion of the wrench handle to which the head is connected are configured to eliminate any excess material and minimize the overall dimensions of the wrench head and pivot point placement relative to the fastener engaging and load bearing aperture in the wrench head. As a result, the distance from the pivotal connection of the wrench head to the forward edge of the wrench head is minimized, and the width of the wrench head and of the overall wrench tool is also minimized. Further, the distance from the pivot axis between wrench head and handle and the inner edge of the wrench head aperture is also minimized, at or near zero.

Most articulating wrenches of the prior art maybe generally characterized as having a wrench head with a pivot arm or extension member that protrudes from the wrench head and fits into a slot formed in the handle. In some articulated wrenches of the prior art a pair of extensions protrude from the wrench head to form a slot into which a portion of the handle is inserted. A pivot pin is used to pivotally connect the wrench head to the handle. In the wrench of the invention, the extension members present in wrenches of the prior art are eliminated and the wrench head is nested directly into the end of the wrench handle.

The end of the handle is formed with a U-shaped depression. The wrench head is preferably formed in a circular or slightly ovoid configuration with a central fastener engaging aperture, and with cutouts formed so that the wrench head fits into the depression in the end of the handle. A pivot pin extends through aligned pin apertures in the handle and the portion of the wrench head nested into the handle depression to secure the head to the handle and allow the head to pivot relative to the handle. In the preferred embodiment of the wrench of the invention the pin aperture is immediately adjacent to the fastener engaging, load bearing aperture in the wrench head, with little or no space between the inner edge of the fastener engaging aperture and the pin aperture. This placement of the pin aperture relative to the fastener engaging aperture in the wrench head serves to minimize the distance between the pivot pin holding the wrench head to the handle and the center, or rotational axis, of the fastener to be engaged and turned with the wrench.

The portion of the wrench head surrounding the fastener engaging aperture, between the edge of that aperture and the outer edge of the wrench head, is a generally circular annular section around at least the portion of the wrench head extending outwardly from the handle. The width of that annular band of material is selected to minimize both the width and the forward extension of the wrench head while maintaining sufficient strength and rigidity to the wrench head to assure the structural integrity and load bearing capacity of the wrench. Minimizing the wrench head dimensions minimizes the clearance required between a fastener and adjacent obstruction(s) for the wrench head to fit into that space and fully engage the fastener.

The wrench of the invention may include an articulated box end head, open end head, or both. The wrench of the invention may include an articulated head at only one end of the handle or at both ends of the handle. If two articulated heads are used they may be of the same type or of different types. The invention also includes an articulated wrench head for use with a socket drive handle. The structure and features of the wrench of the invention will be described in more detail with reference to the accompanying drawing figures.

DETAILED DESCRIPTION OF THE INVENTION

Figure 1:
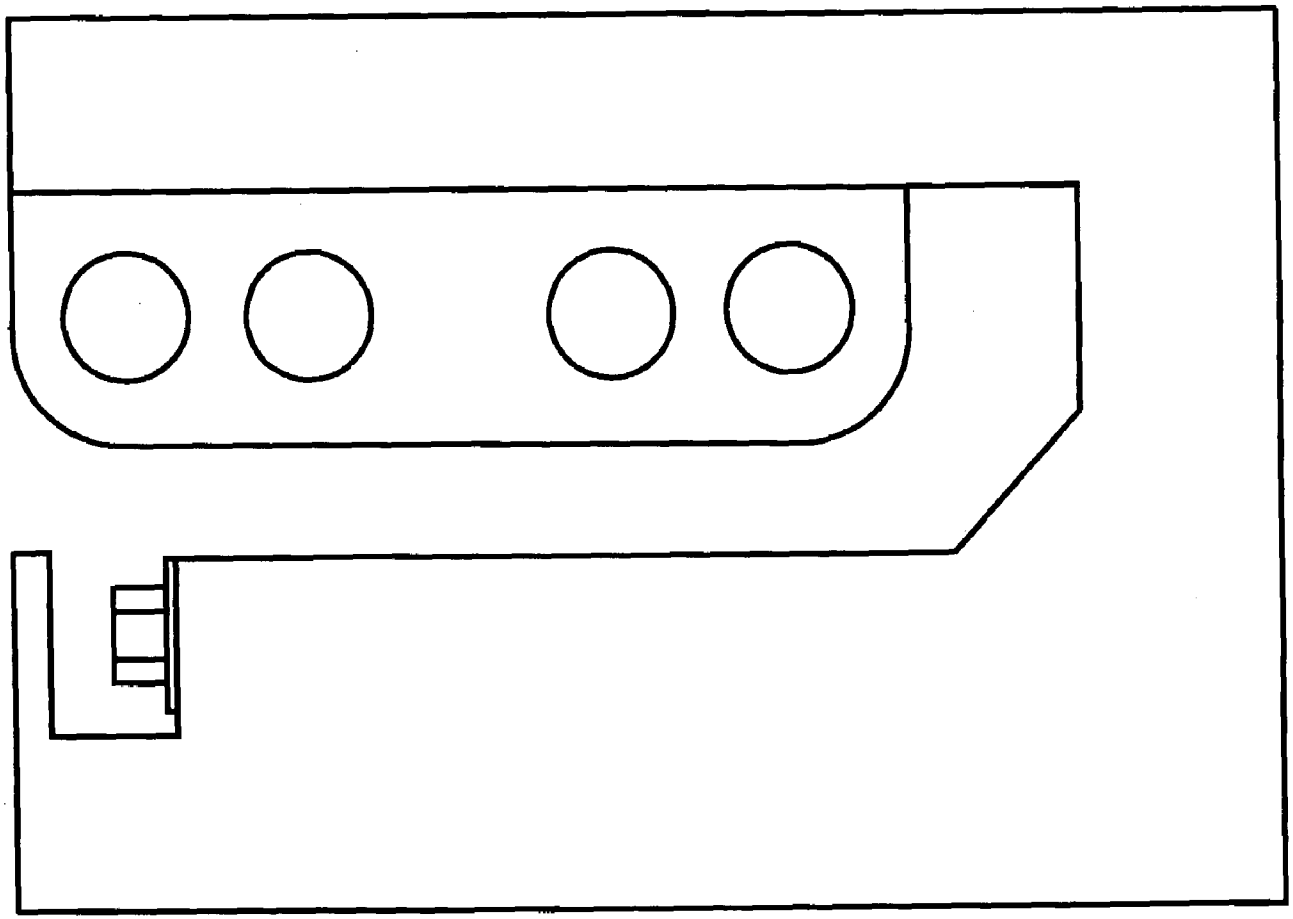
FIG. 1 is a side elevation view showing a fastener disposed in a constricted space and inaccessible by wrenches known in the prior art, illustrating an environment in which a wrench of the invention may be advantageously used.
Figure 2:
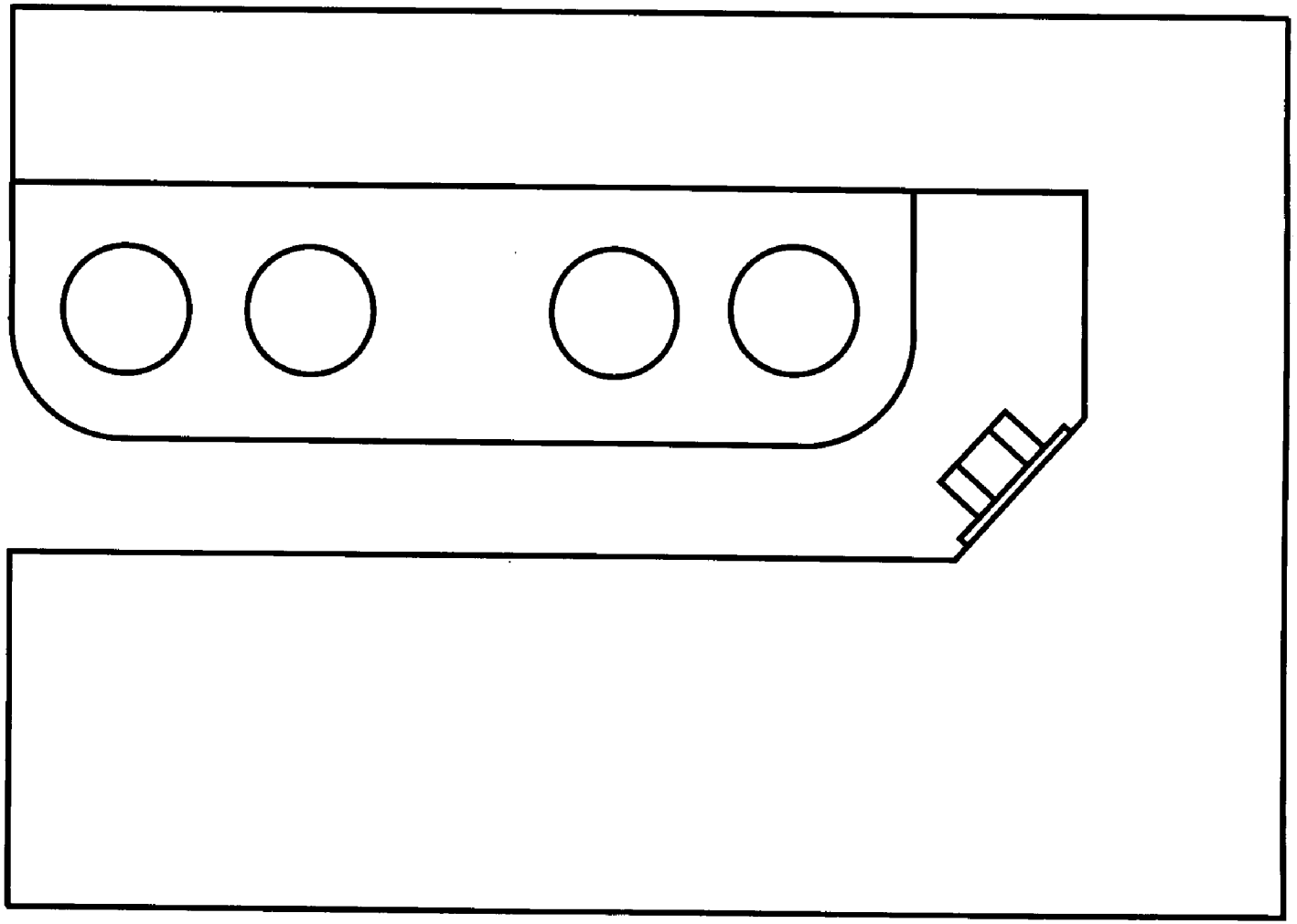
FIG. 2 is a side elevation view showing a fastener disposed in another constricted space in which it is inaccessible by wrenches known in the prior art, as another illustration of an environment in which a wrench of the invention may be advantageously used.
Figure 3:
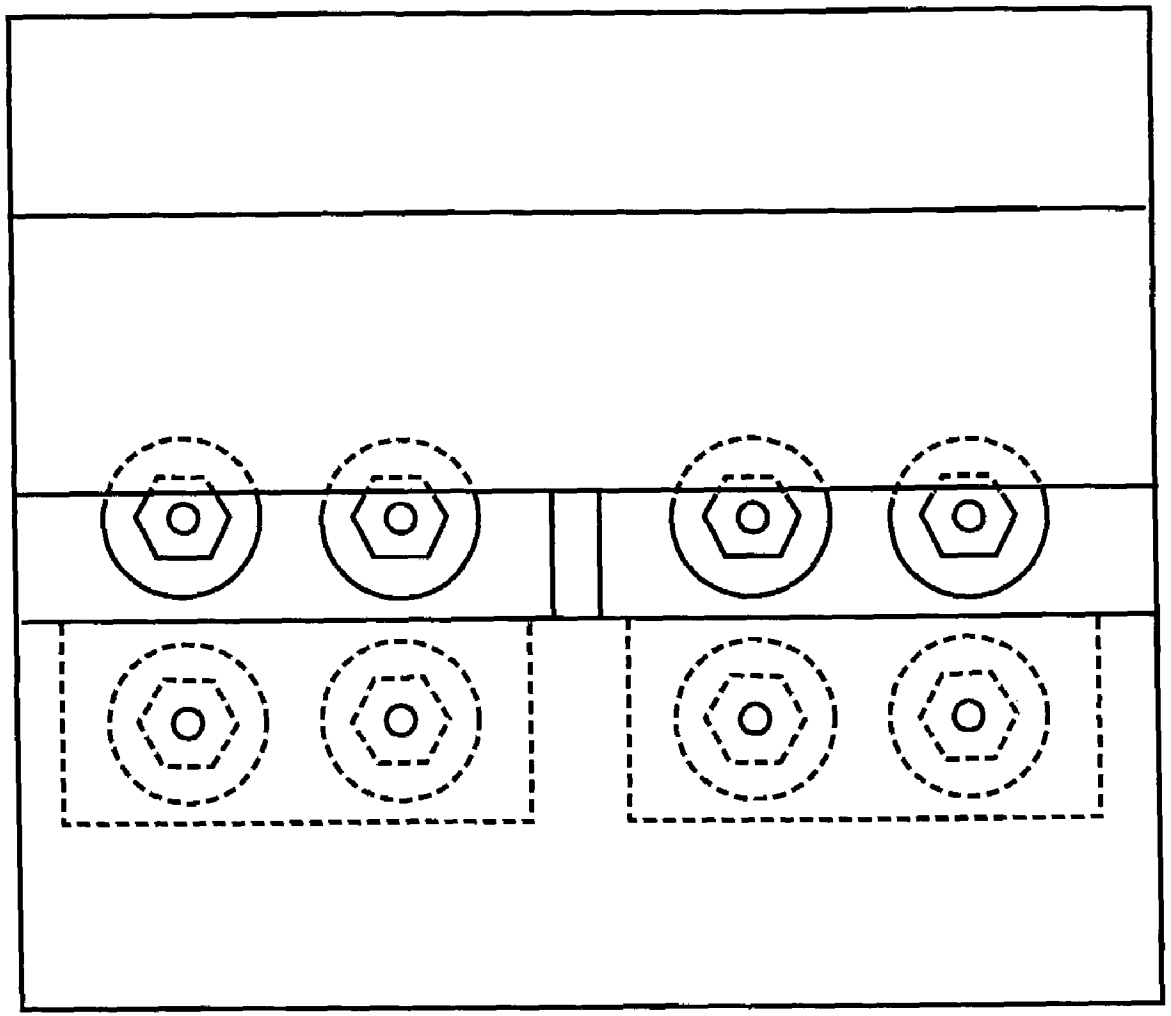
FIG. 3 is a top view of fasteners disposed in a constricted space accessible only through a narrow opening, illustrating another environment in which a wrench of the invention may be advantageously used.

Referring to the drawing figures, the wrench of the invention, generally designated by reference numeral 10, includes a handle 11, and a wrench head 12 disposed at the first end 13 of the handle. In the preferred embodiment handle 11 comprises an elongate bar of greater width than thickness, but, except as may be specifically addressed below, the configuration of handle 11 is not critical to the invention and a variety of configurations may be used within the scope of the invention.

Figure 4:
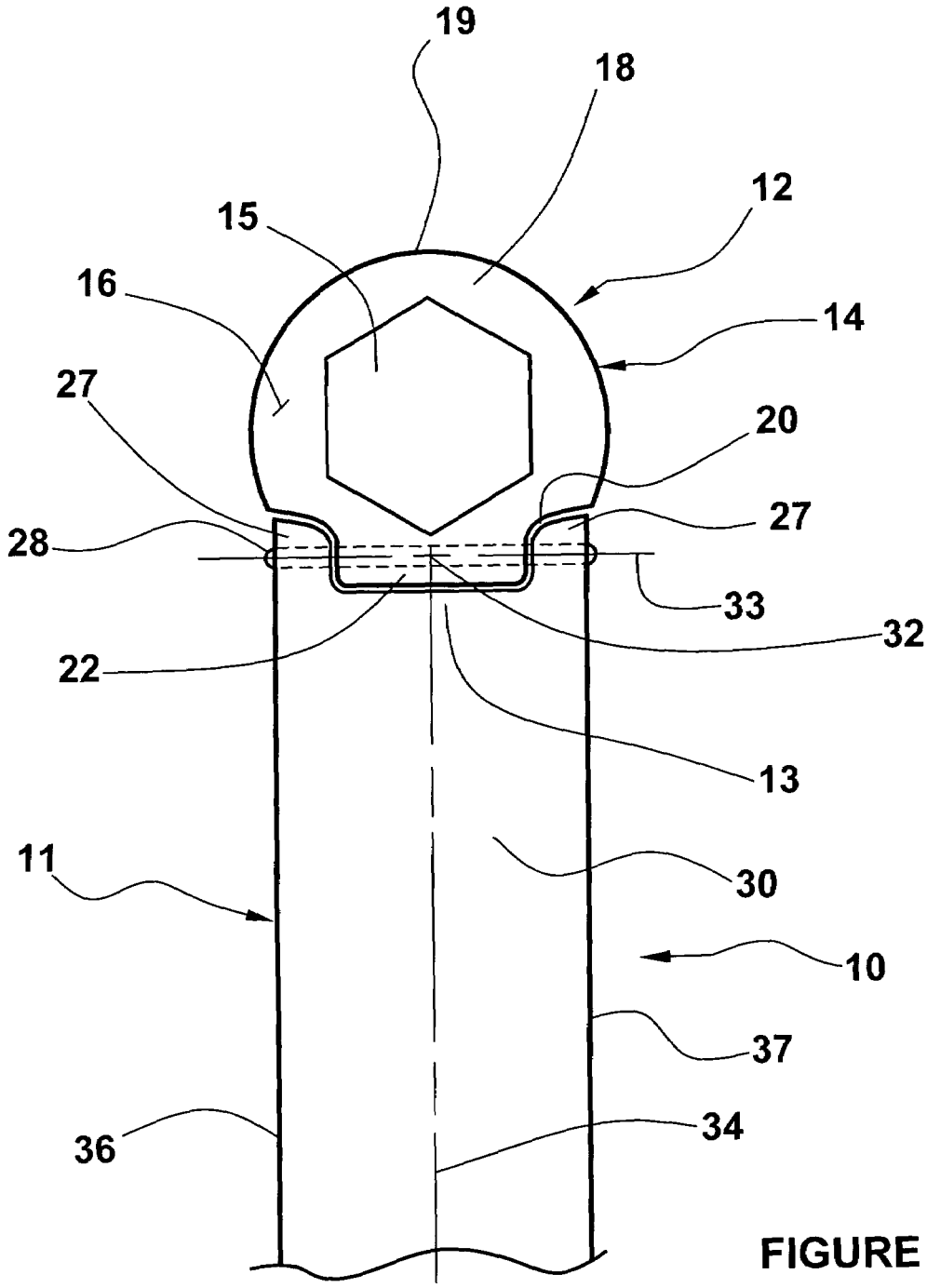
FIG. 4 is a top plan view of a preferred embodiment of the wrench of the invention.
Figure 5:
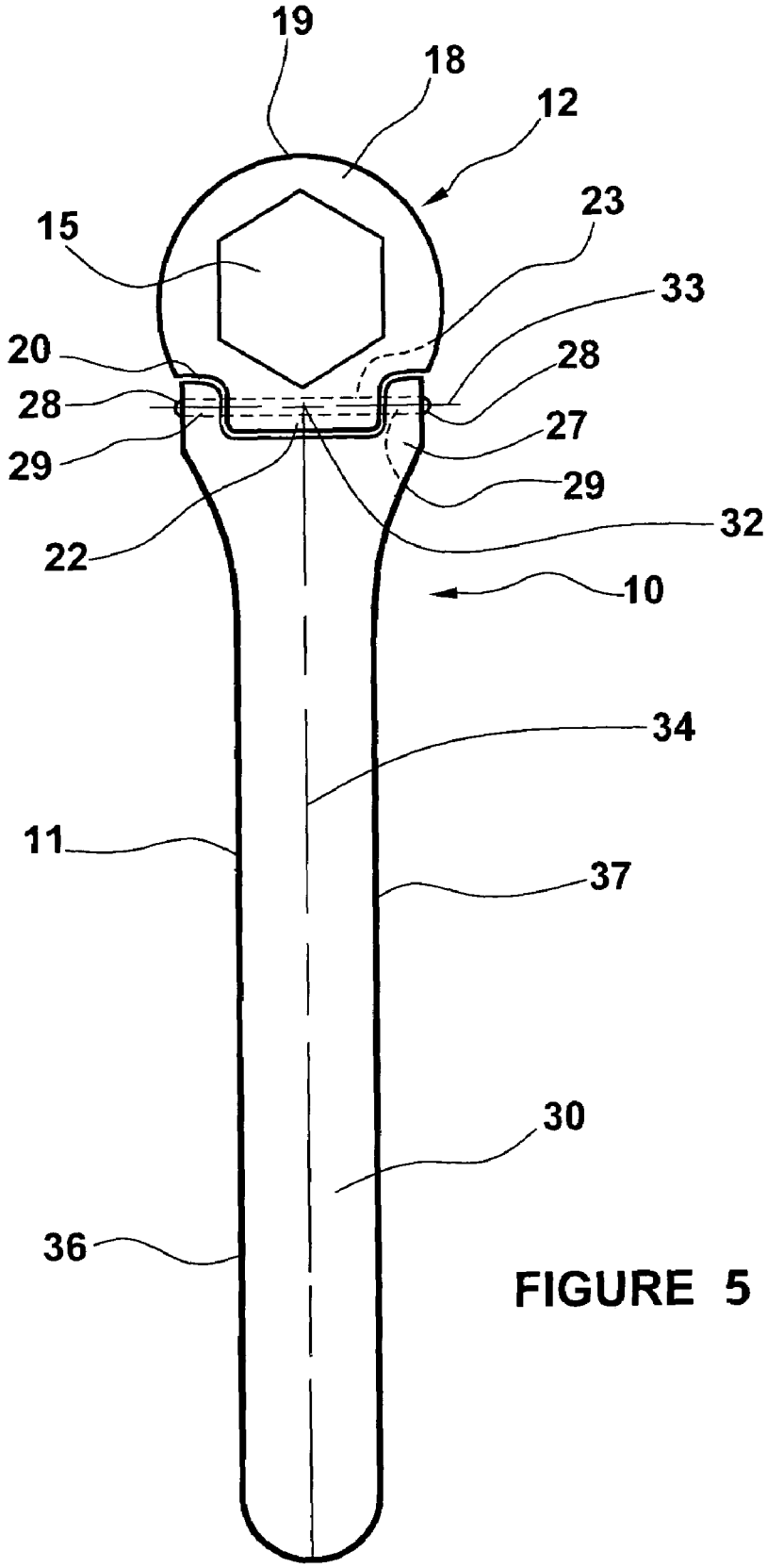
FIG. 5 is a top plan view of a preferred embodiment of the wrench of the invention, with a variation in the handle configuration.

Wrench head 12 is preferably formed as a planar, substantially circular body 14. A polygonal load bearing fastener engaging aperture 15 extends through body 14 between its upper face 16 and its lower face 17, leaving a solid annular rim 18 between aperture 15 and outer edge 19 of the wrench head body. As shown in, e.g., FIGS. 4 and 5, head 12 is a box-end head and aperture 15 is hexagonal. Other head types and aperture configurations may be used, as described below. A pair of cutouts 20 are formed in body 14, symmetrically disposed on either side of a diameter line 21 extending through the center of body 14 and through two opposing points of aperture 15. In the preferred embodiment the center of aperture 15 is preferably slightly offset from the center of body 14, along that same diameter line, toward the portion of the edge of body 14 opposite cutouts 20. However, it is to be understood that offsetting aperture 15 is not essential to the invention, and aperture 15 may, if desired, be centered in body 14 within the scope of the invention.

The portion of annular rim 18 remaining between cutouts 20 forms a boss 22. Pivot pin aperture 23 extends through boss 22 perpendicular to diameter line 21 and generally equidistant between upper face 16 and lower face 17 of body 14. Pin aperture 23 extends through boss 22 immediately adjacent to the closest point of aperture 15, and pin aperture 23 is positioned as near to the closest point of aperture 15 as possible, consistent with maintaining sufficient material in boss 22 to prevent fracture as turning force is applied to the wrench. It is preferred that the distance between the pin aperture and the closest point of aperture 15 be less than, and certainly no greater than, the diameter of the pin aperture, and the scope of the invention encompasses a structure in which the pin aperture actually intersects the closest point of aperture 15. The outer edge 24 of boss 22 between cutouts 20 is preferably flattened, as shown in the drawing figures, so that outer edge 24 extends generally parallel to the longitudinal axis 25 of pin aperture 23. In the preferred embodiment the length of the longest chord line across body 14 that intersects both cutouts 20 is approximately equal to the width of handle 11 at its first end 13.

A generally U-shaped shallow depression 26 is formed in first end 13 of handle 11, 25 leaving edges 27 bordering depression 26. The configuration of depression 26 matches the configuration of boss 22, and the configuration of bordering edges 27 matches the configuration of cutouts 20. Boss 22 of head body 14 is received in depression 26 and each of bordering edges 27 extends into the respective cutout 20 on either side of boss 22. A pivot pin 28 extends through a pair of coaxially aligned handle pin apertures 29 in bordering edges 27, and through pin aperture 23 in boss 22 of the wrench head body to pivotally connect wrench head 12 to handle 11. The centerline of apertures 29 is preferably generally equidistant from upper face 30 and lower face 31 of handle 11 at end 13. The dimensions of depression 26 and bordering edges 27 are such as to provide sufficient space between the handle structure and the wrench head structure to avoid interference between the two components as the wrench head is pivoted relative to the handle. The intersections between outer edge 19 and upper and lower faces 16 and 17 may be slightly rounded through cutouts 20 and boss 22, and the facing edges of depression 26 and bordering edges 27 may also be slightly rounded, to reduce edge interference and facilitate rotation of wrench head 12 relative to handle 11.

Figure 9:
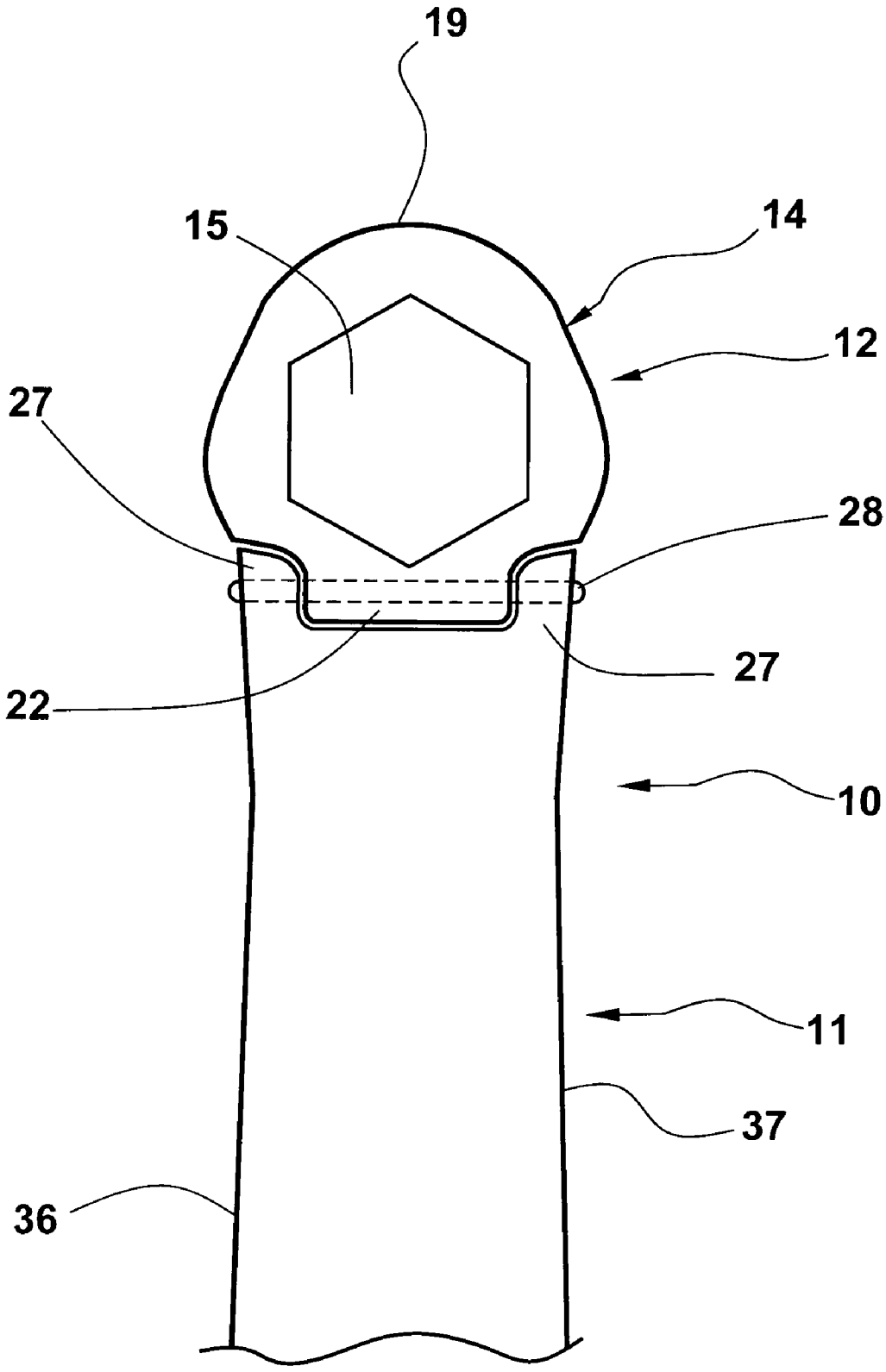
FIG. 9 is a top plan view of a variation of the wrench head, formed in an egg-shaped oval configuration, and a portion of the handle.

In a variation, wrench head body 14 is formed with a slightly egg-shaped oval configuration, as shown in FIG. 9, with the width of annular rim 18 between outer edge 19 and the edge of aperture 15 reduced in the portion of annular rim 18 forward of cutouts 20 and boss 22. The width of the portion of annular rim 18 including cutouts 20 and boss 22 is preferably not reduced, so as to assure the presence of sufficient material in that portion of body 14 for the formation of the cutouts and boss and the maintenance of appropriate strength and load bearing capacity. Reduction of the width of the annular rim reduces the overall width of the wrench head, and reduces the outward extension of the wrench head from its connection to the handle, without compromising the ability of the wrench to bear the forces and stresses imposed during use. It is preferred that the degree of elongation of body 14 from a circular configuration to an ovoid configuration be limited, such that the maximum length or distance of extension of the ovoid body outwardly from edge 24 of boss 22 is not more than about twenty-five percent greater than the maximum width of body 14.

Figure 10:
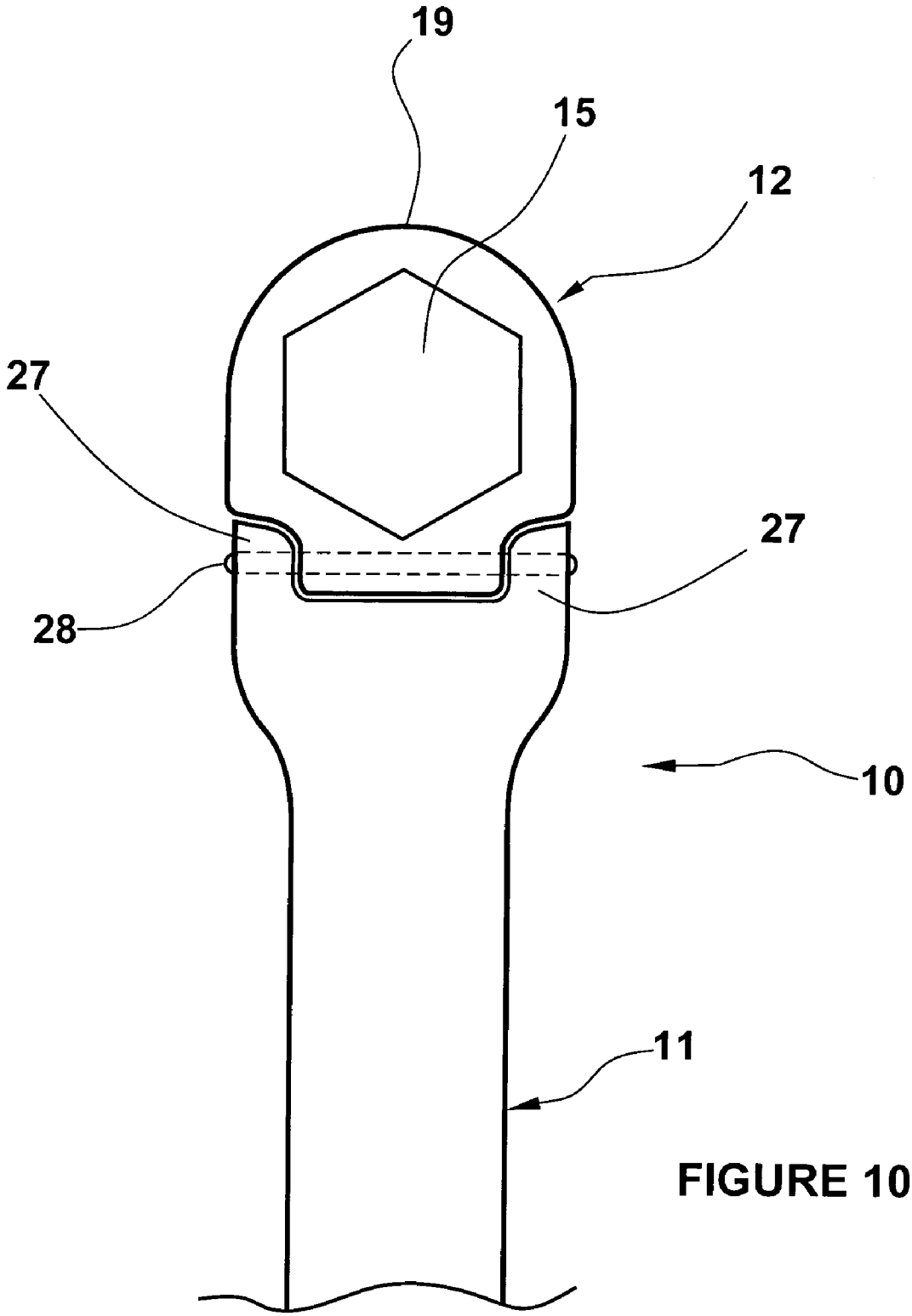
FIG. 10 is a top plan view of a variation of the wrench head, formed in a different oval configuration, and a portion of the handle.

In a further variation, body 14 may be formed with a different oval configuration, characterized as two semi-circles of equal diameter at the ends of the semi-circles, jointed by straight line segments, as shown in FIG. 10. In this variation, as in the egg-shaped oval variation, the elongation from circular is preferred to be no more than a twenty-five percent of the diameter of the semi-circles.

In the oval wrench head embodiments the fastener engaging aperture is preferably offset toward the end of the oval opposite boss 22. These variations may be used to ensure that there is sufficient material in the portion of the wrench head in which cutouts 20 and boss 22 are formed to ensure the structural integrity of the wrench head in situations in which high turning forces are required or anticipated.

It is preferred that pivot pin 28 be fitted in apertures 23 and 29 with sufficient frictional resistance to maintain the position of the wrench head relative to the handle, while allowing the wrench head to be readily pivoted relative to the handle. It is preferred that the wrench head be moveable through the full range of allowed articulation without obstruction and without step-by-step indexing, to facilitate use of the wrench and to allow smooth alteration of the angle between the wrench head and handle during the process of turning a fastener engaged by the wrench.

In the preferred embodiment of the wrench of the invention the distance between the center point 32 of pivot pin 28 along longitudinal axis 33 of the pivot pin and the closest point of fastener engaging aperture 15 is less than the distance between the center point 32 of pivot pin 28 and the upper face 30 and lower face 31 of handle 11. When head 12 is rotated through ninety degrees relative to the longitudinal axis of handle 11, a portion of handle 11 will overlie a portion of fastener engaging aperture 15. Nevertheless, even at that extreme degree of articulation of the wrench head relative to the handle, interference with engagement of the wrench head with a fastener is unlikely.

It is also preferred that the distance between the longitudinal axis 33 of pivot pin 28 and the outer edge 24 of boss 22 is less than or equal to the one half the thickness of handle 11 between its upper face 30 and lower face 31 immediately adjacent to depression 26. This proportional relationship ensures that no portion of boss 22 will extend outwardly beyond the face of the handle when the wrench head is pivoted toward the handle, and thus minimizes the clearance required between a fastener and an adjacent obstruction disposed behind the wrench head and below the handle when the wrench is positioned for use.

It is preferred, even in the oval head variations described above, that the maximum dimension, or distance of extension, of the wrench head body 14 from the point of fastener engaging aperture 15 lying closest to pivot pin 27 to outer edge 19 along a line parallel to the longitudinal axis 34 of handle 11 be less than or equal to the maximum width of body 14 measured along a line parallel to the longitudinal axis 33 of pivot pin 28. It is more particularly preferred in all embodiments that the maximum distance from the longitudinal center point 32 of pivot pin 28 to outer edge 19 be no greater than the maximum width of body 14. This proportional relationship ensures that the length of the wrench head is no longer than required to engage a fastener fully with aperture 15, and minimizes the clearance required between a fastener and an adjacent obstruction in front of the leading edge of the wrench when it is positioned for use.

The depth to which cutouts 20 extend into annular rim 18 between outer edge 19 and the inner edge of fastener engaging aperture 15, and the corresponding length of bordering edges 27 which extend into the cutouts, is optimized to provide sufficient material of construction in the bordering edges and in the annular rim of the wrench head at the cutouts to balance the load bearing capacity of the wrench handle and the wrench head. Similar considerations come into play in selecting the diameter of the pivot pin and associated apertures relative to the thickness of the wrench head and the thickness of the handle and bordering edges. Readily available materials commonly used for wrench construction provide ample strength to assure the integrity of the structure of the wrench of the invention and ample load bearing capacity under reasonable conditions of use.

Figure 11:
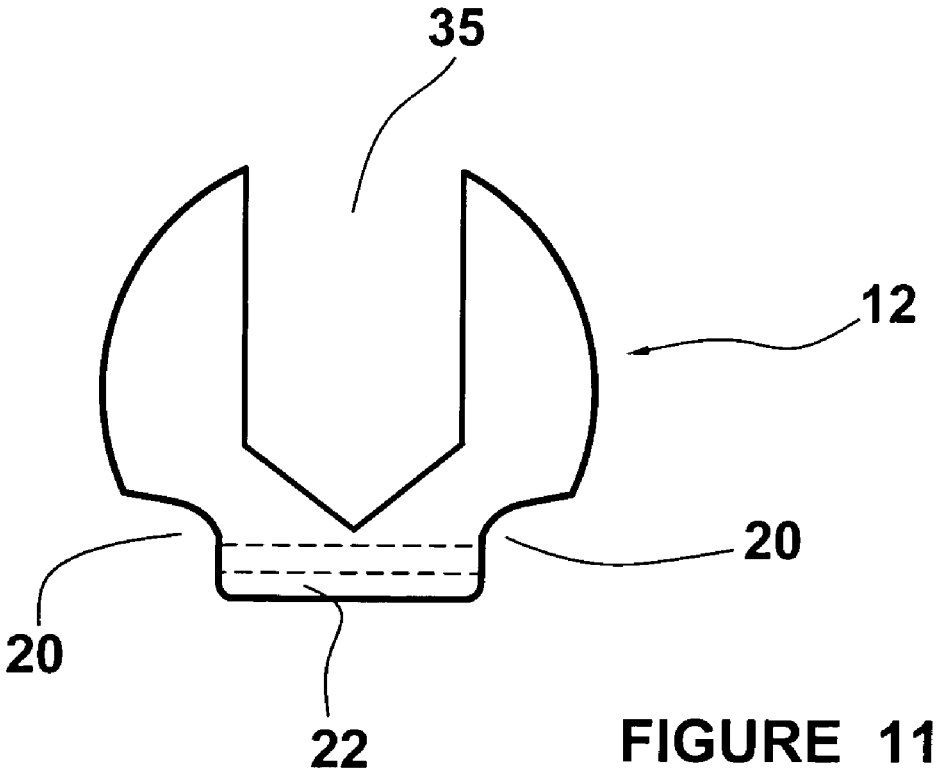
FIG. 11 is a top plan view of an open end variation of the wrench head, in which the fastener engaging aperture is a slot.

In another embodiment of the wrench of the invention, wrench head 12 is formed with an open-end structure, as shown in FIG. 11. In this embodiment, fastener engaging aperture 15 is extended forward through annular rim 18 to form an open-end slot 35 with parallel walls extending through the majority of the depth of the open-end slot. In this embodiment the structure of body 14 of wrench head 12 is preferably otherwise unchanged from the structure described above, and the proportional relationships are also unchanged, providing the same benefits of minimum clearance requirements in an open-end wrench design.

Figure 12:
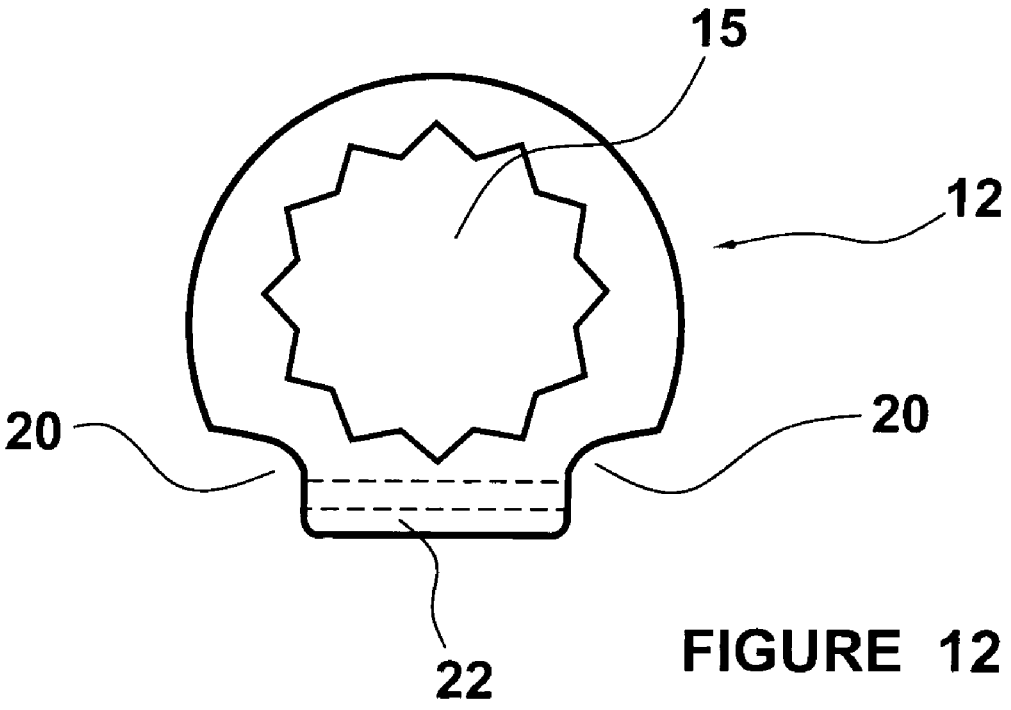
FIG. 12 is a top plan view of a box end variation of the wrench head, in which the fastener engaging aperture is a twelve point dodecagon.
Figure 13:
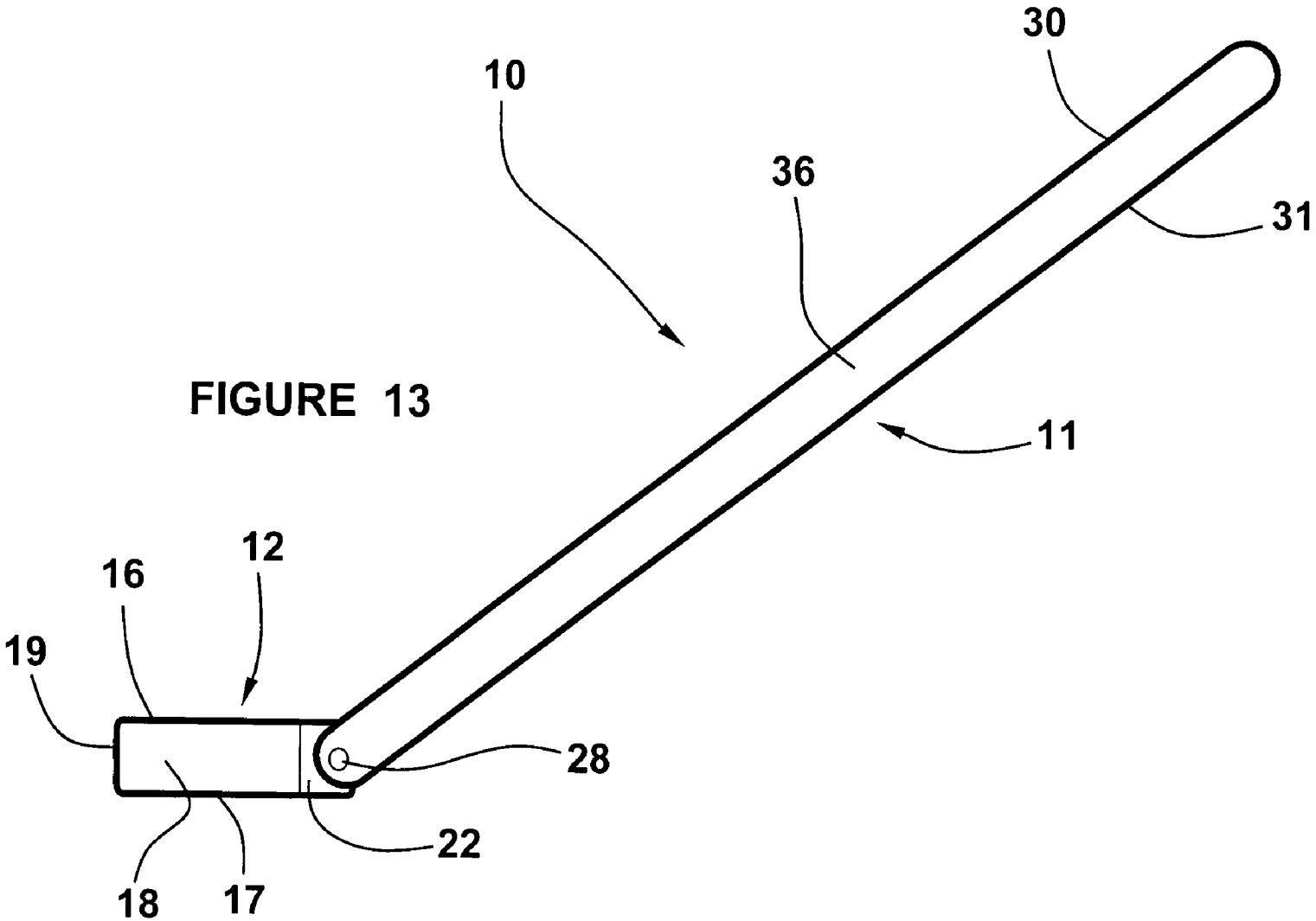
FIG. 13 is a side elevation view of a preferred embodiment of the wrench of the invention, showing the wrench head at an angle to the plane of the handle.

Similarly, wrench head 12 may be provided with a twelve-point, or dodecagonal, fastener engaging aperture, as shown in FIG. 12, instead of the hexagonal configuration described above. In this embodiment it is also preferred that the fastener engaging aperture be oriented with points of the aperture aligned on the centerline of the wrench head body parallel to the longitudinal axis 34 of the handle.

It is preferred that the wrench of the invention be provided in a range of sizes, with the dimensions of fastener engaging aperture 15, and the other dimensions of the wrench components varied to accommodate a specific fastener size. The proportional relationships described above remain unchanged. The use of adjustable or multi-size fastener engaging means or apertures is not preferred in the context of the wrench of the invention, and is inconsistent with the objective of the present invention to minimize the clearance required between a fastener and closely positioned obstructions. Although the proportional relationships referred to above remain unchanged regardless of the size of the fastener to be engaged, the proportional relationship of the width of handle 11 between bordering edges 27 adjacent to first end 13, relative to the width of handle 11 between side edges 36 and 37 farther removed from first end 13, may vary. Handle width in conventional non-adjustable wrenches typically varies with the size of the fastener engaging aperture. For smaller sizes the handle is smaller, and the handle width increases as fastener size increases, up to a point. For larger sizes increasing the handle width is unnecessary for strength, and makes the wrench unnecessarily heavy and cumbersome to hold and operate. With the wrench of the invention the width of the handle between bordering edges 27 is determined by the dimension of wrench head 12 and distance between cutouts 20, but the width of handle 11 between edges 36 and 37 is not material to the invention, and is selected in accordance with the general criteria applied to conventional wrench handles. Accordingly, within the scope of the invention the width of handle 11 between bordering edges 27 may be equal to or greater than the general width of the handle between edges 36 and 37.

Figure 16:
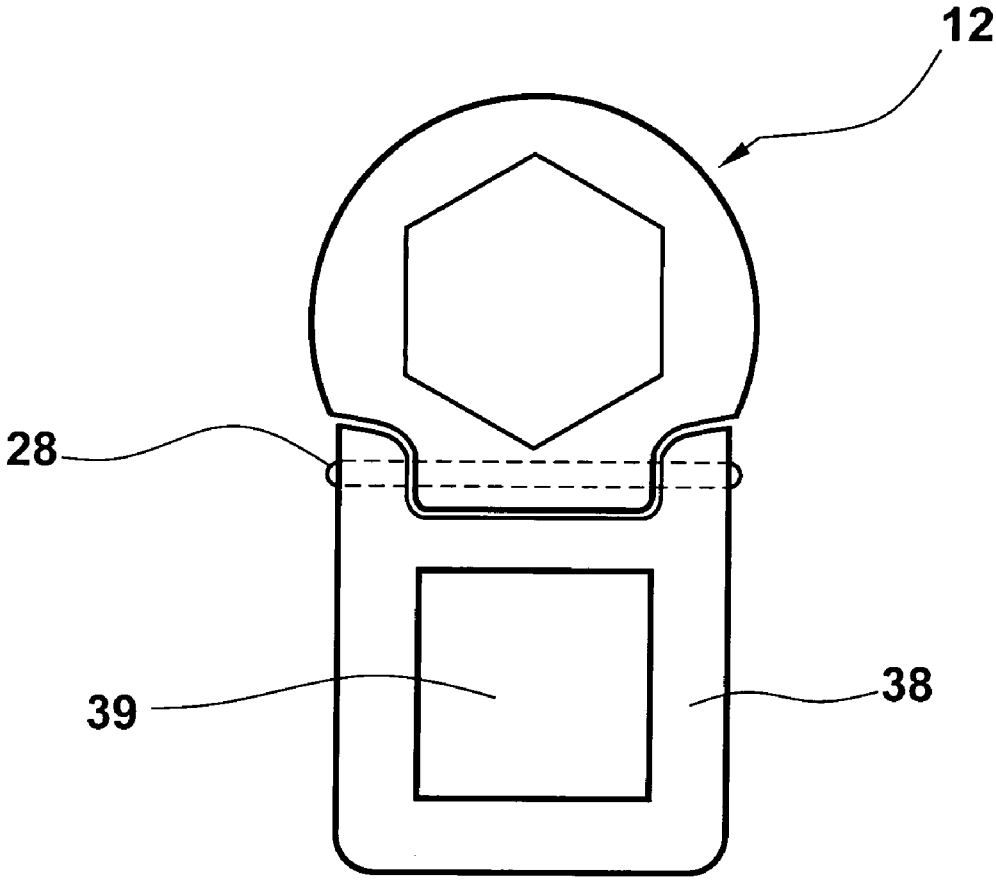
FIG. 16 is a top plan view of an alternative crow-foot embodiment of the wrench of the invention, with a short handle stub penetrated by a driver aperture.

The structure and proportional relationships of the preferred embodiment of the wrench of the invention can be readily modified in an alternative embodiment to provide an articulating crow-foot wrench, as shown in FIG. 16, to be driven by, e.g., a square driver. In this embodiment handle 11 of the preferred embodiment is shortened to form a driver stub 38. A driver aperture 39 is formed in stub 38 for the insertion and engagement of a driver shaft. Square drivers are most commonly used with crow-foot wrenches, and the crow-foot embodiment of the invention is illustrated with a square driver aperture. However, the scope of the invention is not limited to any particular driver configuration, and a hexagonal driver aperture 39 as one example, could be used. Similarly, the crow-foot embodiment of the invention is illustrated with a box-end head and a hexagonal fastener engaging aperture, but it is to be understood that the scope of the invention is not limited to any particular type or aperture configuration. As non-limiting examples, a twelve point box end design or an open end design may readily be used if desired.

Figure 17:
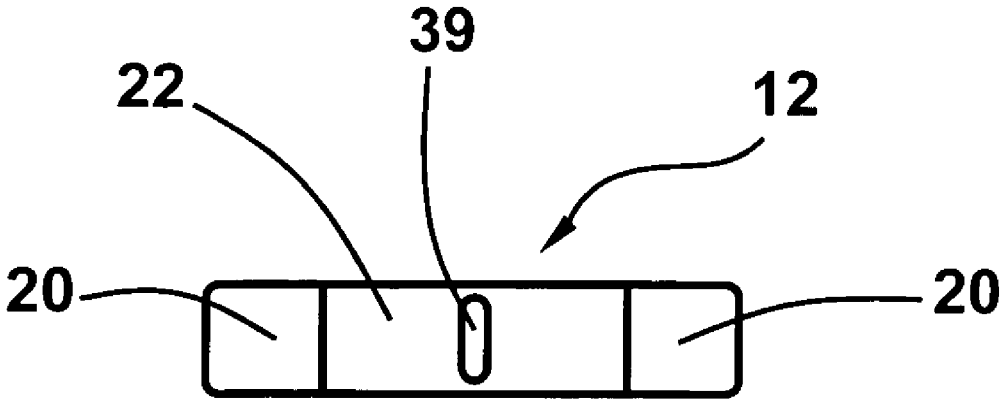
FIG. 17 is an end view of an alternative embodiment of the wrench head, illustrating a stop means for limiting rotation of the head relative to the handle.
Figure 18:
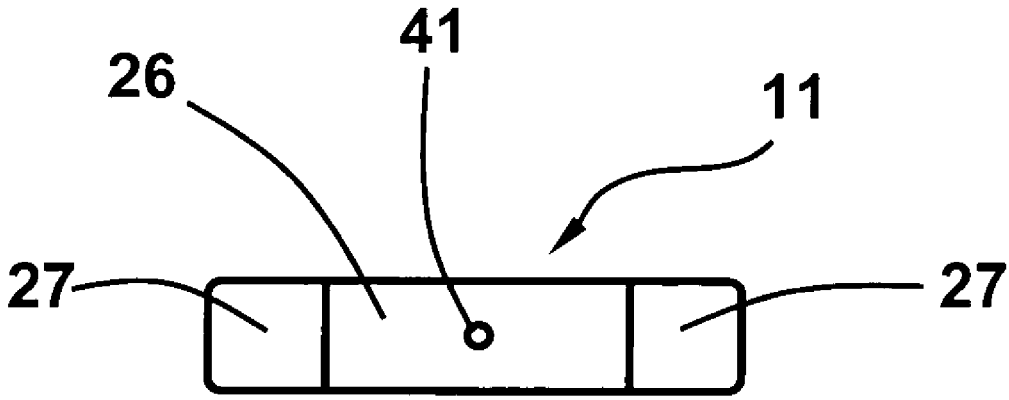
FIG. 18 is an end view of the first end of an alternative embodiment of the handle, illustrating a stop means.

In the preferred embodiments of the wrench of the invention, head 12 is allowed to rotate through a range of positions from parallel to handle 11 to perpendicular to the handle. In many circumstances it is desirable to allow rotation through the maximum range, but in other circumstances of use it may be more desirable to restrict the degree of rotation of the head relative to the handle. An alternative embodiment of the wrench of the invention, illustrated in FIGS. 17 and 18, may be employed as a means of limiting the range of rotation of the head.

In the alternative embodiment a groove 40 is formed in edge 24 boss 22, perpendicular to the longitudinal axis 25 of aperture 23. A stop pin 41 is provided in depression 26 of the handle, to be received in groove 40 when head 12 is connected to handle 11. In this embodiment, the head may be rotated in either direction until the stop pin encounters the ends of the groove, thereby preventing further rotation of the head. If stop pin 41 is coaxially aligned with the longitudinal axis 34 of the handle, the head will be allowed to pivot in either direction. If it is desired to allow the head to pivot in only one direction, stop pin 41 may be offset toward one face of the handle, so that the stop pin rests against one end of groove 40 when the head is in the same plane as the handle and rotation of the head in one direction is prevented. However, rotation of the head in the other direction is allowed until the stop pin encounters the other end of the groove. It will be understood that the degree of rotation of the head relative to the handle may be controlled by varying the length of groove 40. The degree of asymmetrical rotation may also be controlled by varying the placement of stop pin 41. Accordingly, within the scope of the invention, articulating wrenches may be provided for general use and/or for specialized uses in which a particular limitation on rotation may be necessary for effective engagement and manipulation of a component to be turned with the wrench.

Figure 6:
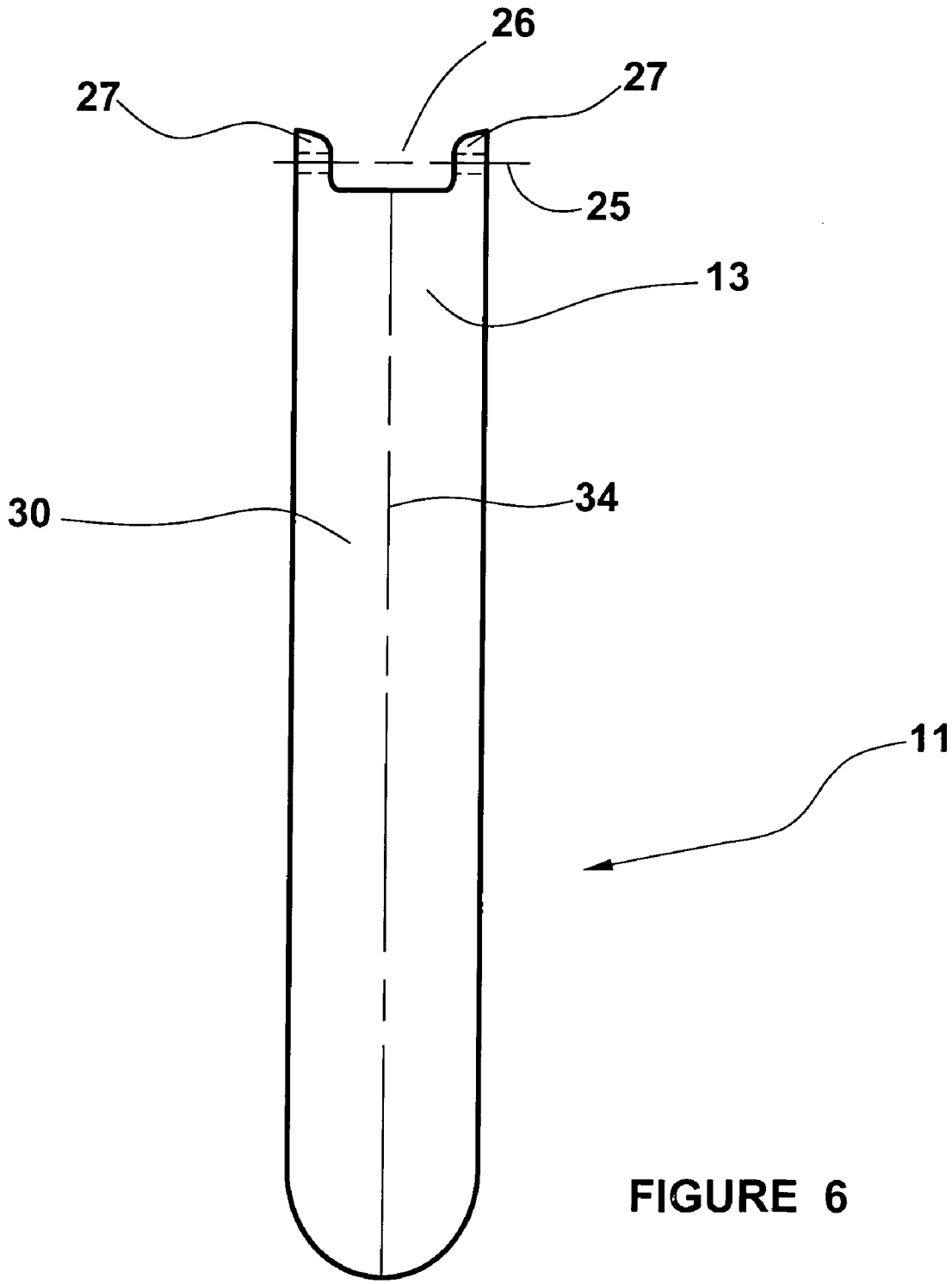
FIG. 6 is a top plan view of the handle of a preferred embodiment of the wrench of the invention, showing the depression formed in the handle and the bordering edges, for connection of the wrench head.
Figure 7:
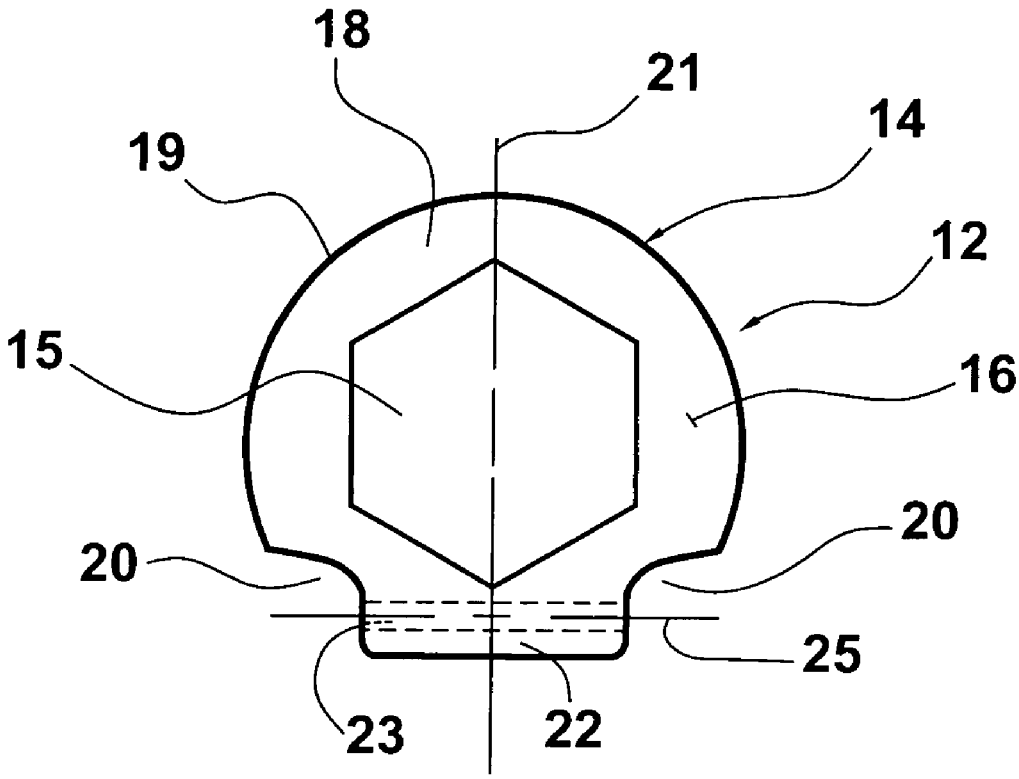
FIG. 7 is a top plan view of a preferred embodiment of the wrench head of the wrench of the invention, formed in a circular configuration.
Figure 8:
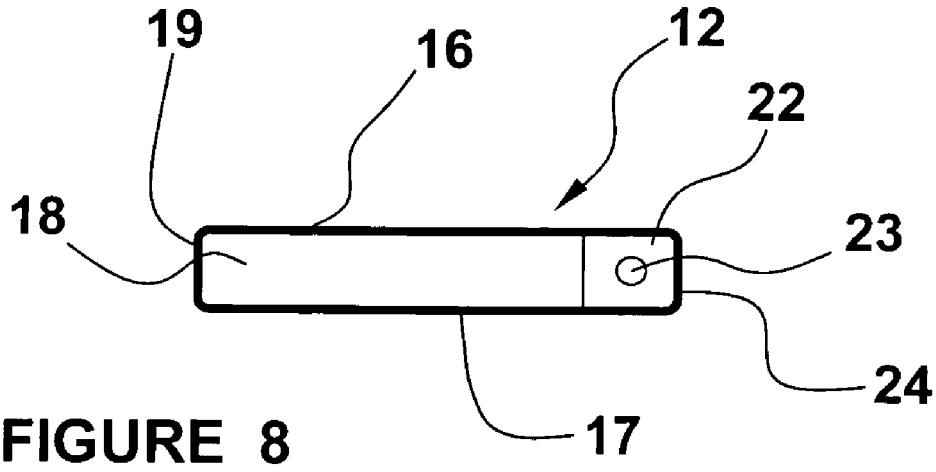
FIG. 8 is a side elevation view of a preferred embodiment of the wrench head of the wrench of the invention.
Figure 14:
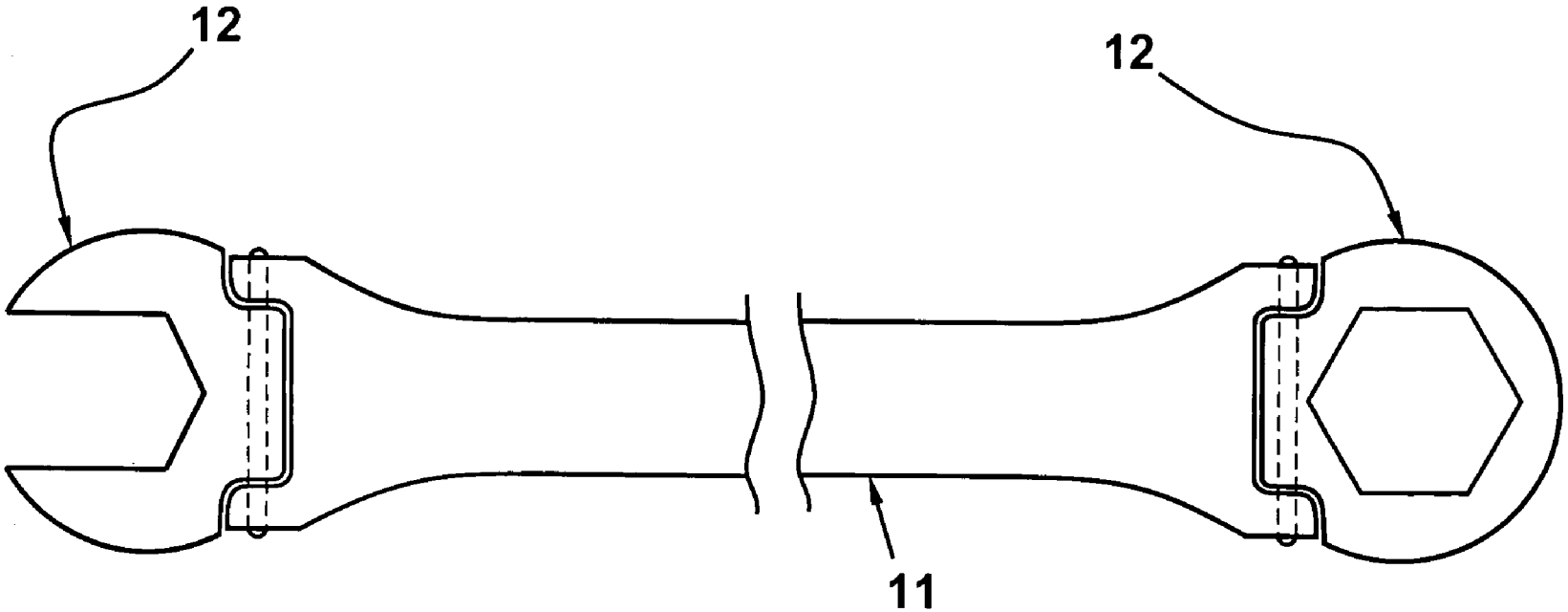
FIG. 14 is a top plan view of an embodiment of the wrench of the invention with a box end wrench head at one end of the handle and with an open end wrench head at the opposite end of the handle.
Figure 15:
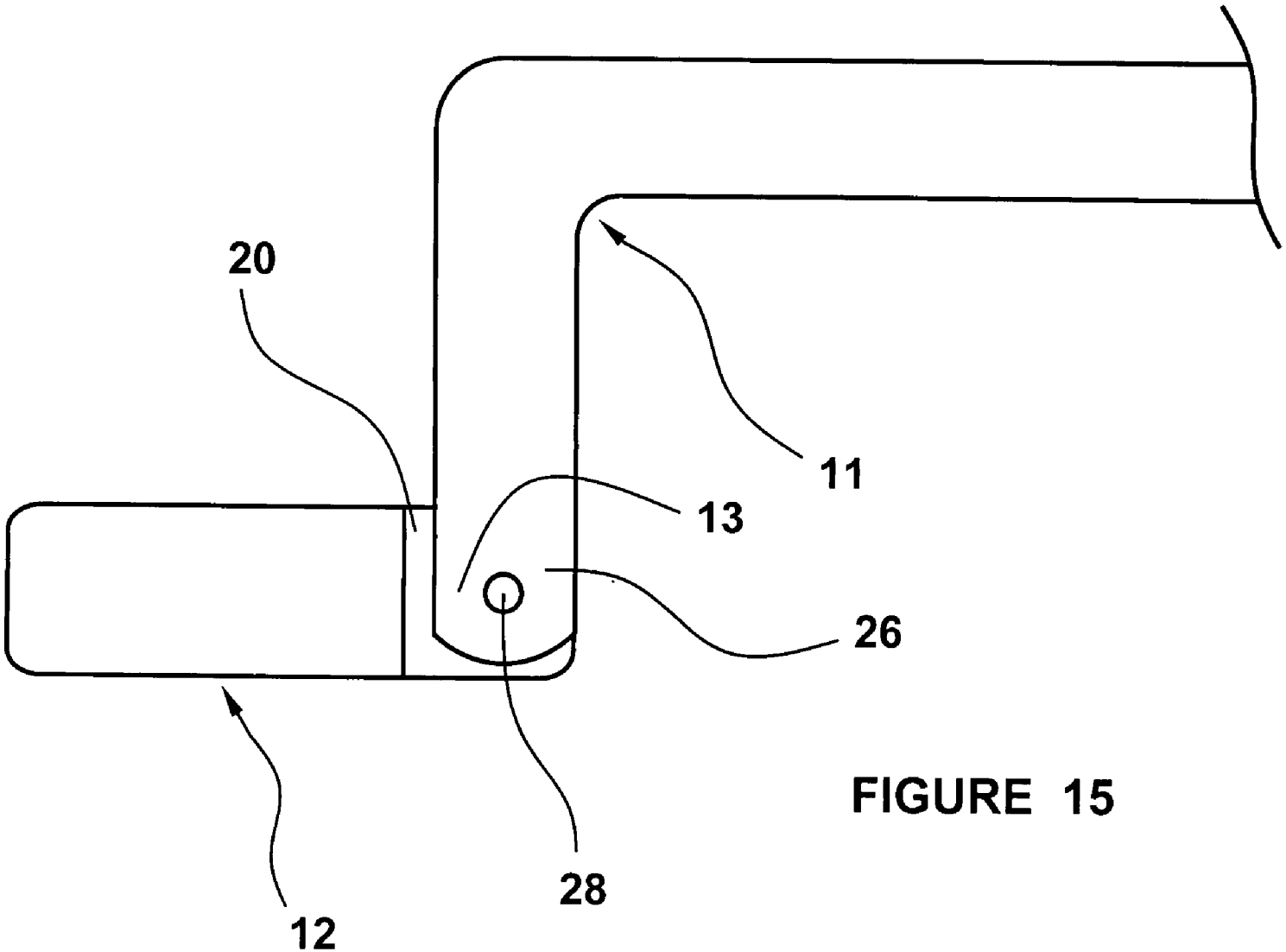
FIG. 15 is a side elevation view of an alternative embodiment of the wrench of the invention, in which the portion of the handle adjacent to the wrench head is bent at an angle relative to the remainder of the handle.

The foregoing discussion has focused on an embodiment of the wrench with one articulating box end head, but it will be understood that the principles and unique features of the invention may be utilized to provide a wrench with an articulating open end head, shown in FIG. 6. In the embodiment of FIG. 6, head 12 is the open end head and head 13 is the box end head. In the open end wrench head embodiment aperture 14 becomes a slot to receive the component to be engaged and turned, and the ring or annulus surrounding the box end head aperture referred to above is broken by the opening of the slot. The wrench of the invention may also be provided with two articulating heads, as illustrated in FIG. 14, both of the same type or of different types, with one connected to handle 11 at first end 13 and the other connected to handle 11 at its second end 42. The wrench of the invention may further be provided with an articulating head at only one end of the handle, with the other end of the handle left plain, without a wrench head of any type. It should also be noted that while the handle of the preferred embodiment has been described as of generally planar configuration, in order to minimize the clearance required, other handle configurations may be used within the scope of the invention. As a non-limiting example, a handle configuration with a ninety degree bend is illustrated in FIG. 15. In this embodiment the plane of the portion of the handle between the bend point and first end 13 is at an angle relative to the remainder of the handle, it being understood that angles other than the illustrated ninety degree angle may be used if desired. The connection between wrench head 12 and handle 11 is as described above. This embodiment allows the wrench of the invention to be used to access fasteners that would otherwise be inaccessible to either the other embodiments of the wrench of the invention or to wrenches of the prior art. Further variations and alternative embodiments may be provided as well, all within the scope of the invention.

The foregoing description of the invention is illustrative and not limiting, and the scope of the invention as defined by the claims is intended to encompass such variations and further alternative embodiments as well as the preferred and alternative embodiments described herein.

The invention claimed is:

1. An articulating wrench for engaging and turning a fastener, comprising a handle with first and second ends, with first and second opposed edges, with first and second opposed faces, and with a longitudinal axis, said handle having a shallow generally U-shaped depression extending into said handle from said first end between said edges so as to form a pair of bordering edges in opposed relation on either side of said depression, and said handle having a pair of coaxially aligned handle pin apertures, each of said handle pin apertures extending through one of said bordering edges perpendicular to said longitudinal axis of said handle; and a wrench head formed as a generally planar body having an upper face and a lower face, with a fastener engaging aperture formed in said body, said fastener engaging aperture surrounded by a generally annular rim having an outer edge at the periphery of said body and an inner edge defining said fastener engaging aperture, said rim having a pair of cut-outs extending inwardly from said outer edge of said rim, said cut-outs defining a boss therebetween, said boss having an outer edge and said boss being penetrated by a pivot pin aperture, said wrench head partially nested into said handle with said boss extending into said depression in said handle with said bordering edges extending into said cutouts and said handle pin apertures coaxially aligned with said pin aperture in said boss, and said wrench head pivotally connected to said handle by a pivot pin extending through said coaxially aligned apertures, said pivot pin having a longitudinal axis and a longitudinal center point on said longitudinal axis, with the distance between said center point on said longitudinal axis of said pivot pin and the point of said fastener engaging aperture lying closest to said center point on said longitudinal axis of said pivot pin being less than the minimum distance between said center point on said longitudinal axis of said pivot pin and said upper face of said handle and less than the minimum distance between said center point on said longitudinal axis of said pivot pin and said lower face of said handle.

2. The articulating wrench of claim 1, wherein said pivot pin aperture in said boss is circular in cross sectional configuration and has a diameter, and wherein the minimum distance between said pin aperture in said boss and said fastener engaging aperture is less than said diameter of said pivot pin aperture.

3. The articulating wrench of claim 1, wherein said pivot pin aperture penetrating said boss has a longitudinal axis, and wherein the minimum distance between said longitudinal axis of said pivot pin aperture and said fastener engaging aperture is less than the minimum distance between said longitudinal axis of said pivot pin aperture and said outer edge of said boss.

4. The articulating wrench of claim 1, wherein said annular rim is continuous, and wherein fastener engaging aperture is hexagonal in configuration.

5. The articulating wrench of claim 1, wherein said annular rim is continuous, and wherein said fastener engaging aperture is dodecagonal in configuration.

6. The articulating wrench of claim 1, wherein said fastener engaging aperture is a slot with an open outer end, a closed inner end, and parallel walls extending between said outer end and said inner end, said slot extending through said rim generally opposite from said boss.

7. The articulating wrench of claim 1, wherein the configuration of said body of said wrench head in said plane of said body is generally circular.

8. The articulating wrench of claim 7, wherein said body has a centerline perpendicular to said plane of said body, wherein said fastener engaging aperture has a center, and wherein said center of said fastener engaging aperture is offset from said centerline of said body away from said boss.

9. The articulating wrench of claim 7, wherein said body has a centerline perpendicular to said plane of said body, wherein said fastener engaging aperture has a center, and wherein said center of said fastener engaging aperture is aligned with said centerline of said body.

10. The articulating wrench of claim 1, wherein said body of said wrench in said plane of said body is configured as an egg-shaped oval with a narrow end and a wide end, and wherein said cutouts and said boss are formed in said wide end.

11. The articulating wrench of claim 10, wherein said fastener engaging aperture is offset toward said narrow end of said oval body.

12. The articulating wrench of claim 1, wherein said handle is elongate, and wherein said wrench further comprises a second wrench head connected to said handle at said second end thereof.

13. The articulating wrench of claim 12, wherein said second wrench head is pivotally connected to said handle at said second end thereof.

14. The articulating wrench of claim 1, wherein said handle is formed as a short stub, and wherein said handle includes a driver aperture penetrating said handle through said first and second faces and between said first and second edges adjacent to said depression in said first end of said handle, said driver aperture to receive a driver shaft disposed generally perpendicular to said longitudinal axis of said handle.

15. The articulating wrench of claim 1 further including a stop structure for limiting rotation of said wrench head around said pivotal interconnection to said handle, wherein said stop structure comprises an elongate groove formed in said outer edge of said boss, said groove extending generally perpendicular to said plane of said body of said wrench head, and a stop pin extending outwardly from said depression in said first end of said handle parallel to said longitudinal axis of said handle, to be received in said groove.

16. The articulated wrench of claim 15, wherein said stop pin is offset from said longitudinal axis of said handle toward one of said faces of said handle.

17. An articulating wrench for engaging and turning fasteners in a confined space, comprising an elongate generally planar handle with first and second ends, with first and second opposed edges, with first and second opposed faces, and with a longitudinal axis, said handle having a shallow generally U-shaped depression extending into said handle from said first end between said edges so as to form a pair of bordering edges in opposed relation on either side of said depression, and said handle having a pair of coaxially aligned handle pin apertures, each of said handle pin apertures extending through one of said bordering edges perpendicular to said longitudinal axis of said handle; and a wrench head formed as a generally planar body of a generally circular configuration, having an upper face and a lower face, with a fastener engaging aperture formed in said body, said fastener engaging aperture surrounded by a generally annular rim having an outer edge at the periphery of said body and an inner edge defining said fastener engaging aperture, said rim having a pair of cut-outs extending inwardly from said outer edge of said rim, said cut-outs defining a boss therebetween, said boss having an outer edge and said boss being penetrated by a pivot pin aperture, said wrench head partially nested into said handle with said boss extending into said depression in said handle with said bordering edges extending into said cutouts and said handle pin apertures coaxially aligned with said pin aperture in said boss, said wrench head pivotally connected to said handle by a pivot pin extending through said coaxially aligned apertures so as to allow rotational movement of said wrench head relative to said plane of said handle, said pivot pin having a longitudinal axis and a longitudinal center point on said longitudinal axis, with the minimum distance between said longitudinal axis of said pivot pin and said fastener engaging aperture being not greater than the minimum distance between said longitudinal axis of said pivot pin and said outer edge of said boss.

18. The articulating wrench of claim 17, wherein said minimum distance between said longitudinal axis of said pivot pin and said outer edge of said boss is not greater than one half the thickness of said handle between said upper face thereof and said lower face thereof adjacent to said depression.

19. The articulating wrench of claim 17, wherein the maximum distance between said longitudinal centerpoint of said pivot pin and said outer edge of said rim is not greater than the maximum width of said body of said wrench head in said plane of said body.

* * * * *